United States Patent [19]

Mohrenstecher et al.

[11] Patent Number: 4,721,065

[45] Date of Patent: Jan. 26, 1988

[54] PROCESS AND APPARATUS FOR COOLING HOT PROCESS GAS FROM A PRESSURE GASIFICATION REACTOR

[75] Inventors: Horst Mohrenstecher; Ulrich Premel, both of Gummersbach, Fed. Rep. of Germany

[73] Assignee: L. & C. Steinmuller GmbH, Gummersbach, Fed. Rep. of Germany

[21] Appl. No.: 9,411

[22] Filed: Jan. 30, 1987

[30] Foreign Application Priority Data

Jan. 31, 1986 [DE] Fed. Rep. of Germany ..... 3602935

[51] Int. Cl.[4] ..... F22D 1/00

[52] U.S. Cl. ..... 122/7 R; 122/32

[58] Field of Search ..... 122/7 R, 470, 32

[56] References Cited

U.S. PATENT DOCUMENTS

| | | | |
|---|---|---|---|
| 4,352,341 | 10/1982 | Styslinger | 122/32 X |
| 4,462,339 | 7/1984 | Jahnke et al. | 122/7 R |
| 4,488,513 | 12/1984 | Jahnke et al. | 122/7 R X |
| 4,535,727 | 8/1985 | Ziegler | 122/32 |

*Primary Examiner*—Edward G. Favors

*Attorney, Agent, or Firm*—Young & Thompson

[57] ABSTRACT

In a process for cooling hot process gases from a pressure gasification reactor the hot process gas is passed through a heat exchange with water to produce saturated steam and then in countercurrent heat exchange with said saturated steam to generate superheated steam, production of saturated steam and superheated steam are performed in a single pressure vessel. Correspondingly the two necessary heating surfaces packages are arranged in an upright pressure vessel one above the other.

6 Claims, 2 Drawing Figures

PROCESS AND APPARATUS FOR COOLING HOT PROCESS GAS FROM A PRESSURE GASIFICATION REACTOR

BACKGROUND OF THE INVENTION

The present invention relates to a process for cooling hot process gases from a pressure gasification reactor. Saturated steam is produced by cooling the process gas by means of heat exchange with a supply of water. From leaflet "Process Engineering Equipment", page 13, published in 1976 by L. & C. Steinmuller GmbH a process is known, with which process gases produced by partial oxidation of hydrocarbons at pressures of up to 100 bar approximately and temperatures of up to 1500° C. are led to a heat exchanger connected to the gasification reactor to form a steam generator.

In the steam generator only saturated steam is produced. In gas generator plants, in which hydrogen by non-catalytic breaking up of hydrocarbons on the basis of partial oxidation of oil is generated, it is known to produce the superheated steam necessary for the gasification process in a separate superheater apparatus, which is directly fired with any other fuel.

It is an object of the present invention to provide a process, with which the superheated steam can be produced by the hot process gas itself.

BRIEF DESCRIPTION OF THE DRAWING

This object an other objects and advantages of present invention, will appear more clearly from the following specification in connection with the accompanying drawings.

SUMMARY OF THE INVENTION

Figure 1:
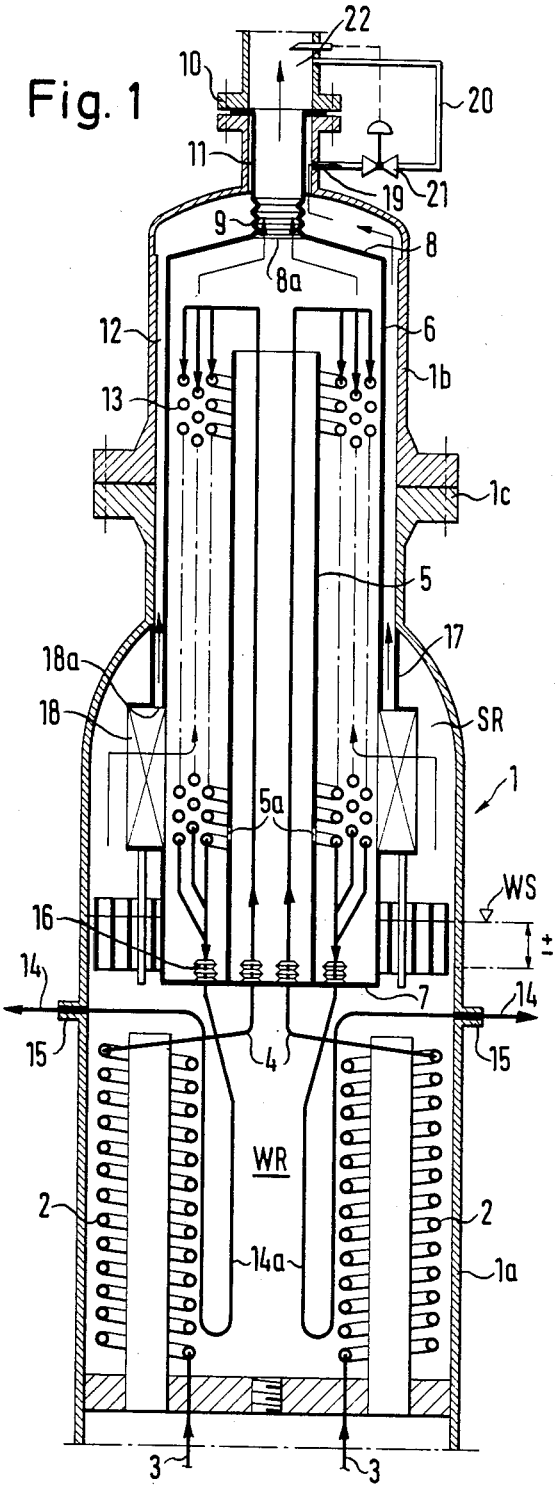
FIG. 1 is an elevational part section view of an apparatus for cooling the process gases and generating superheated steam in a single pressure vessel in an arrangement having features according to the present invention.

The present invention contemplates a process for cooling hot process gas from a pressure gasification reactor, with which saturated steam is produced by cooling the process gas by means of heat exchange with a supply of water and with which superheated steam necessary for the gasification is produced. This process includes the steps of:

producing said saturated steam by partially cooling said process gas by means of said heat exchange and producing said superheated steam by leading at least the greater part of said saturated steam after separation of water therefrom in a countercurrent heat exchange with said partially cooled process gas;

said partially cooling and said countercurrent heat exchange being performed in a single pressure vessel. By integrating the superheating in the cooling of the process gas the separate superheating of the saturated steam by direct firing can be deleted. A second pressure vessel is not necessary.

To extract as much heat from the process gas for the production of steam as possible it is of advantage, to subject the process gas after the heat exchange with the saturated steam again to another heat exchange with the water volume, since after cooling of the process gases normally the soot and ash particles in the process gas are removed in a wet gas cleaning step.

Finally it is of advantage, if a part or the entire saturated steam is guided as a mantle stream envelopping the range of superheating. In doing so it is provided that the pressure vessel used for the process is protected in the range of superheating against overheating and that aditionally a temperature control of the superheated steam by mixing of the part streams is possible.

The invention is also directed to a heat exchanger comprising:

an upright pressure vessel including a water space, and a saturated steam space above said water space;

a water inlet to said water space;

at least one heating surfaces package;

a gas inlet for passing hot process gas under pressure to said heating surfaces package;

at least one water separator arranged in said saturated steam space and at least one superheater heating surfaces package, through which deviated saturated steam is flowing and which is connected to the heating surfaces package and to a gas outlet, respectively, by means of process gas tubes and in such a manner that the process gas flows through the superheater heating surfaces package in countercurrent with respect to the superheated steam and a steam outlet connected to said superheater heating surfaces package.

With this heat exchanger the superheater is integrated in the pressure vessel of the known waste-heat system after gasification.

Since the process gas has to be guided from the water space into the saturated steam space and since the superheating range has to be separated from the water space and the saturated steam space, it is of advantage, if the superheater heating surfaces package is disposed in an annular space between a central tube and a guiding sleeve, which is at least closed at its lower end by a bottom, said annular space being connected at one end thereof to the saturated steam space. The superheating surfaces package includes preferably coiled heating surfaces. The guiding sleeve extends with its closed end beyond the minimum water level in the water space and at least the process gas tubes, which forward the process gas from the heating surfaces package serving for evaporation, are passed through the bottom of the guiding sleeve in such a manner that the process gas tubes in the range of passing the bottom are biased on one side always by steam and on the other side always by water.

Two embodiments are preferred:

With the one embodiment it is provided that the saturated steam enters the annular space from above, that the central tube ends with an open end in a predetermined distance from the bottom of the guiding sleeve, and that the outlet for the superheated steam is provided at the upper end of the central tube, that the process gas tubes forwarding the process gas are connected with the lower end of the superheater heating surfaces package and that the process gas tubes leading the process gas away from the superheater heating surfaces package are connected to the gas outlet provided above the water space.

With the other embodiment it is provided that the saturated steam enters the annular space from below, that the central tube is also closed at its lower end and that the process gas tubes forwarding the process gas are passed through the central tube open at its upper end to the upper end of the superheater heating surfaces package, that the process gas tubes leading the process gas away from the superheater heating surfaces package are passed through the bottom of the guiding sleeve into the water space, and that the outlet for the superheated steam is provided at the closed upper end of the guiding sleeve. To avoid overheating of the wall of the pressure vessel and to reduce the calculation temperature for the flanged joints in case of a multisectional design of the pressure vessel with flanged joints it is further of advantage to dispose the guiding sleeve at least over a predetermined section of its length in a predetermined distance from the inner side of the wall of the pressure vessel and to bias the annular space between guiding sleeve and inner side of the wall of the pressure vessel with saturated steam. In doing so it is further preferred that with the other embodiment the saturated steam can flow via at least one control valve to the steam outlet. To take from the process gas leaving the superheater heating surfaces package as much heat as possible for the steam generation it is further of advantage, if an outlet loop hanging down into the water space is disposed before the outlet. Finally it is preferred that the diameter of the pressure vessel is smaller in the range of the superheater heating surfaces package than in the range of the heating surfaces package.

DESCRIPTION OF PREFERRED EMBODIMENTS

Referring now to the drawings in detail: The heat exchanger includes an upright pressure vessel 1 which comprises a section 1*a* of increased diameter and a section 1*b* of decreased diameter, the section 1*b* being parted in a detachable manner by a flanged joint 1*c*.

In section 1*a* there is provided a water space WR wherein the water level WS can fluctuate in the range +/−shown. In the water spacer WR there is disposed a multipart package 2 of heating surfaces, to which parts a hot pressurized process gas can be led via process gas tubes 3. The parts of the heating surfaces package are not shown in detail in the drawing and are made of heat exchanger tubes; these tubes are guided to extend around displacement bodies either preferably in a helical configuration or in an arrangement having a concentric and winding manner. The process gases leave the preferably helically wound heating surfaces of the heating surfaces package 2 in the range of the water space with a temperature which is about 100° to 200° C. higher than boiling temperature and enter via process gas tubes 4 into a central tube 5 which is closed at its lower end and open at its upper end. The lower end of the central tube lies below the minimum water level WS and the tube extends from section 1a into section 1*b*.

Concentrically to the central tube 5 a guiding sleeve 6 is disposed, which extends beyond the upper end of the central tube and the lower end of which extends as far into the water space WR as the central tube and is also closed. (It is possible that the central tube 5 and the guiding sleeve 6 are closed by the one and same plate 7.) The guiding sleeve 6 is closed at its upper end by a cover 8 having a center opening 8*a*. This opening 8*a* is connected by a connecting unit 9 taking any heat expansion to a connecting tube 11 leading to a steam outlet 10 flanged thereto. The connecting means 9 are preferably of the ballows type.

The diameters of the guiding sleeve 6 and the connecting tube 11 are selected in comparison to the inner diameter of the section 1*b* of the pressure vessel in such a manner that an annular space 12′ remains there between.

A superheater heating surfaces package 13 consisting of a plurality of strands or tubes is wound around the central tube 5. To the upper ends of the strand the process gas is fed via the process gas tubes 4 and at lower ends of the strands the process gas is led away by process gas tubes 14, which are passed through the cover plate 7. The process gas tubes 14 extend internally to gas outlets 15 provided in the wall of the pressure vessel. The process gas tubes 14 are formed with outlet loops 14*a*, which hang down into the water space WR and between the parts of the heating surfaces package 2 as shown in FIG. 1. The process gas tubes 4 and 14 are passed through the cover plate 7 by means of heat expansion compensators 16. Instead of using compensators the passing of the process gas tubes can also be acchieved via cover plates of increased thickness.

The saturated steam accumulating above the water level WS in a saturated steam space SR between the inner wall of the pressure vessel on one hand and the guiding sleeve 5 and a sheet metal steam guide 17 on the other hand passes via water separators 18 into the annular space between the central tube 5 and the guiding sleeve 6 and flows in a countercurrent with the process gas in the superheater heating surfaces package 13 towards the opening 8*a*. During the countercurrent passage the steam is superheated. The water separators 18 are evenly distributed arround the periphery of guiding sleeve 6 and have preferably the form of deviation elements with catching troughs as e.g. described in the U.S. Pat. Nos. 3,977,977 and 3,950,156. Through openings 18*a* provided in the water separators 18 a partstream of the saturated steam enters after water separation into the annular space 12 and flows towards a mantle steam outlet opening 19 at the upper end of the upper section 1*b* of the pressure vessel. A tube conduit 20, in which a hot steam control valve 21 is arranged, is connected with its inlet opening to the outlet opening 19 and with its outlet opening to the steam outlet 10. The hot steam control valve 21 is controlled in dependancy on a sensor 22 sensing the temperature of the superheated steam in the steam outlet 10. In doing so the inner wall of the pressure vessel in the range of section 1*b* can be protected against overheating. Furthermore, in dependancy on the socalled fouling factor on that face of the tube contacted by the process gases the hot gas temperature can be controlled by controlling the mantle stream in the annular space 12 by means of the hot steam control valve 21. To enhance the filling of the central tube 5 with saturated steam a plurality of bores 5*a* are provided in the range of the lower end thereof as shown in FIG. 1.

As can be seen in FIG. 1 fluctuations of the water level WS take place only in such ranges that no tube sections, in which process gas is led, are alternatively covered by water or are exposed. The process gas tubes 4 leaving the water space WR and the process gas tubes 14 entering into the water space are biased on one side (above the cover plate 7) by saturated steam only and on the other side (below cover plate 7) by water only. Thus a fluctuating water level does not lead to a shifting of the separation between saturated steam and water along the process gas tubes. In doing so problems with respect to corrosion can hardly be expected. Summing up the process and the apparatus described with respect to FIG. 1 offer the following advantages:

The basic idea of the waste-heat steam generator as well as the proved design of the heating surfaces package 2 of the steam generator can be kept. The gas leading tubes 4 and 14 are not endangered with respect to corrosion and tensions by the water level necessarily fluctuating during operation. By deviating the mantle stream into the annular space 12 it is assured that a varying fouling factor on the inner surface of the process gas tubes of the heating surfaces package 2 and of the superheater heating surfaces package 13 does not lead to a variation of the outlet temperature of the superheated steam at the outlet 10. Furthermore the mantle stream of saturated steam provides that the pressure vessel, especially section **1*b* thereof, is protected against overheating and that the evaluation or calculation temperature for the flanged joint 1*c* can be reduced correspondingly. Finally the apparatus according to the present invention allows the switching off of some of the process gas passes through the multipart heating surfaces package 2 and the multipart superheater heating surfaces package 13** without a negative influence on the circulation of media and the generation of superheated steam. It is also to be remarked that the steam flowing upwardly in the annular space is superheated, but to a lesser extent than the steam flowing upwardly in the annular space between guiding sleeve and central tube.

Figure 2:
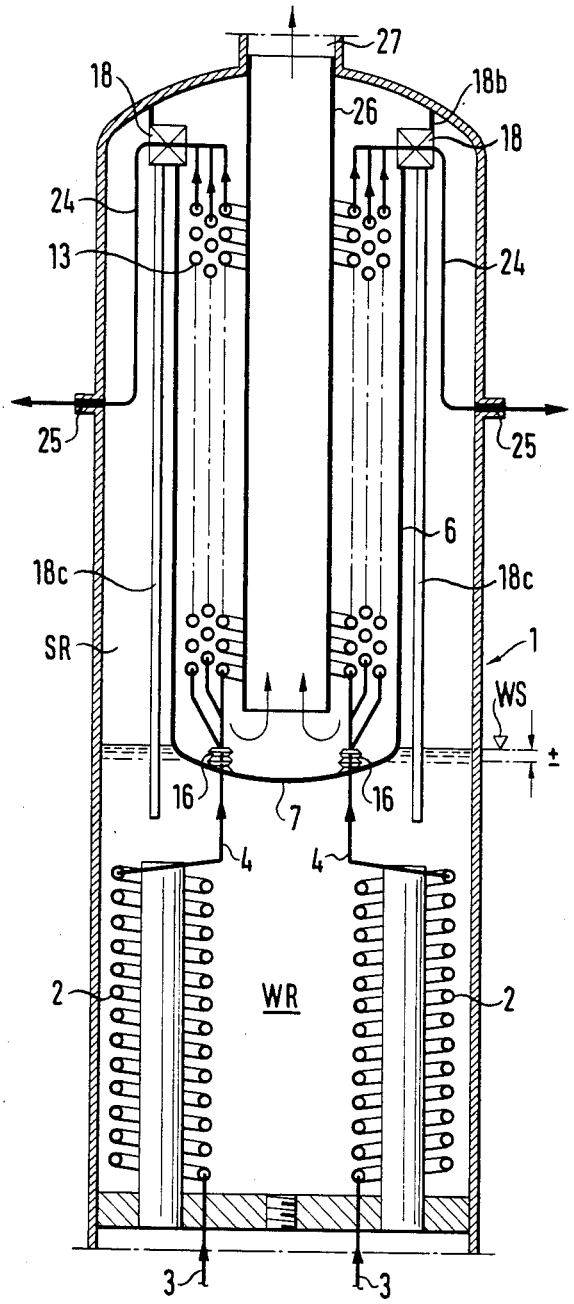
FIG. 2 is an elevational part section view of another embodiment of an apparatus having the features according to the present invention.

In the following description of the embodiment according to FIG. 2 the same reference numbers are used as far as possible. With this embodiment the pressure vessel 1 comprises a straight cylindrical vessel. The process gas tubes 4 are connected to the lower ends of the superheater heating surfaces package 13. The water separators 18 are arranged at the upper end of the guiding sleeve 6 and between the separator 18 and the pressure vessel 1 a sheet metal steam guide **18*b* is provided. It is also possible that the guiding sleeve 6 extends up to the cover section of the vessel. The separated water is led to the water space by down pipes 18*c***.

The process gases leaving the upper end of the superheating surfaces package 13 are guided via process gas tubes 24 to gas outlets 25 lying above the water space WR. In contrary to the embodiment according to FIG. 1 with the embodiment according to FIG. 2 a central tube 26 is provided, the lower end of which ends above the bottom 7 and the upper end of which is connected to the steam outlet 27 of the pressure vessel. The saturated steam from the saturated steam space SR enters into the annular space between the guiding sleeve 6 and the central tube 26, which annular space is open at its upper end, and passes the water separators 18 and the superheater heating surfaces package 13 in countercurrent to the hot process gas.

Also in case of this embodiment the proved design of the evaporator with the heating surfaces package 2 can be kept. The process gas tubes 4, which alone are passed through the bottom 7 of the guiding sleeve 6, are not endangered by corrosion and tensions due to fluctuating water level. The pressure vessel is also protected against overheating in the range of steam superheating, because the saturated steam flows upwardly in the form of a mantle stream, is deviated and enters from above into the annular space between central tube 26 and guiding sleeve 6. With this embodiment some of the process gas passes can also be switched off without negatively influencing the circulation and the hot steam generation.

The present invention is, of course, in no way restricted to the specific disclosure of the specification and drawing, but also encompasses any modifications within the scope of the appendent claims.

What we claim is:

1. A heat exchanger comprising:

an upright pressure vessel including a water space and a saturated steam space above said water space;

a water inlet to said water space;

at least one heating surfaces package;

a gas inlet for passing hot process gas under pressure to said heating surfaces package;

at least one water separator arranged in said saturated steam space and at least one superheater heating surfaces package arranged in said saturated steam space, through which superheater heating surfaces package dewatered saturated steam is flowing and which is connected to said heating surfaces package and to a gas outlet, respectively, by means of process gas tubes in such a manner that the process gas flows through the superheater heating surfaces package in countercurrent with respect to be saturated steam and a steam outlet connected to said superheater heating surfaces package;

the superheater heating surfaces package being disposed in an annular space between a central tube and a guiding sleeve closed at least at its lower end by a bottom, said annular space being connected at one end thereof to said saturated steam space, the guiding sleeve extending with its closed lower end beyond the minimum water level in the water space, and at least the process gas tubes forwarding the process gas from said heating surfaces package passing through the bottom of the guiding sleeve in such a manner that the process gas tubes are in a range of passing through the bottom biased on one side always by steam and on the other side by water.

2. A heat exchanger according to claim 1, wherein the saturated steam enters into the annular space at the upper end thereof that the central tube ends in an unclosed manner and in a predetermined distance from the bottom of said guiding sleeve and that the outlet for the superheated steam is provided at the upper end of the central tube, that the process gas tubes forwarding the process gas are connected with the lower end of the superheater heating surfaces package and that the process gas tubes leading the process gas away from the superheater heating surfaces package are connected to said gas outlet lying above the water space.

3. A heat exchanger according to claim 1, wherein the saturated steam enters into the annular space at the lower end thereof, that the central tube is also closed at the lower end thereof and that the process gas tubes forwarding the process gas are passed through the central tube open at its upper end to the upper end of the superheater heating surfaces package, that the process gas tubes leading the process gas away from said superheater heating surfaces package are passed through said bottom of said guiding sleeve into the water space and in that the outlet for the superheated steam is provided at the closed upper end of said guiding sleeve.

4. A heat exchanger according to claim 1, wherein said guiding sleeve is arranged at least over a predetermined section of its length in predetermined distance from the inner side of the wall of the pressure vessel and said annular space between said guiding sleeve and said inner side of the wall of said pressure vessel is biased with saturated steam.

5. A heat exchanger according to claim 1, wherein the saturated steam may be passed via at least one control valve from the annular space between said guiding sleeve and said wall of the pressure vessel to said steam outlet.

6. A heat exchanger according to claim 3, wherein an outlet loop hanging down into said water space is provided before said gas outlet.

* * * * *